US006945479B2

(12) United States Patent
Boehland et al.

(10) Patent No.: US 6,945,479 B2
(45) Date of Patent: Sep. 20, 2005

(54) STROKE-CONTROLLED VALVE AS FUEL METERING DEVICE OF AN INJECTION SYSTEM FOR INTERNAL COMBUSTION ENGINES

(75) Inventors: Peter Boehland, Marbach (DE); Godehard Nentwig, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 2 days.

(21) Appl. No.: 10/453,485

(22) Filed: Jun. 4, 2003

(65) Prior Publication Data

US 2003/0222158 A1 Dec. 4, 2003

(30) Foreign Application Priority Data

Jun. 4, 2002 (DE) ..... 102 24 689

(51) Int. Cl.[7] ..... B05B 1/30

(52) U.S. Cl. ..... 239/585.1; 239/585.2; 239/88; 239/90

(58) Field of Search ..... 239/585.1, 585.2, 239/533.11, 88, 89, 90, 91

(56) References Cited

U.S. PATENT DOCUMENTS 5,139,224 A * 8/1992 Bright ..... 251/50
5,630,550 A * 5/1997 Kurishige et al. ..... 239/533.8
6,460,779 B1 * 10/2002 Boecking ..... 239/102.2

* cited by examiner

*Primary Examiner*—Dinh Q. Nguyen
(74) *Attorney, Agent, or Firm*—Ronald E. Greigg

(57) ABSTRACT

A stroke-controlled valve as a fuel metering device of an injection system for internal combustion engines has a valve body with a valve seat and a valve needle which is actuatable in the valve body counter to the resistance of a valve needle restoring spring and which has a sealing edge that cooperates with the valve seat. A coupling body with a greater mass than the valve needle is disposed in the valve body, in the axial extension of the valve needle, and is movable coaxially to the valve needle and is actuatable by the valve needle during the opening stroke of the valve needle.

18 Claims, 2 Drawing Sheets

STROKE-CONTROLLED VALVE AS FUEL METERING DEVICE OF AN INJECTION SYSTEM FOR INTERNAL COMBUSTION ENGINES

BACKGROUND OF THE INVENTION

1. Field of the Invention

The invention relates to a stroke-controlled fuel metering valve for an injection system of an internal combustion engine.

2. Description of the Prior Art

In designing stroke-controlled fuel metering valves for modern injection systems, there is a conflict of purpose in terms of the choice of the valve needle speed. For optimal system performance, high opening and closing speeds are advantageous, since in this way a large proportion of the fuel to be injected is pumped without throttling at the valve seat. However, for metering very small injection quantities, in which the valve needle is not completely opened ("ballistic mode"), a slow valve motion is advantageous, since the metering precision increases as the valve speed drops.

OBJECT AND SUMMARY OF THE INVENTION

It is the object of the invention to make suitable provisions for more-precise metering of small injection quantities, which are typical for a preinjection, for stroke-controlled injection systems, yet at the same time as much as possible to reduce power losses caused by throttling in the valve seat.

Preferably, the coupling body is disposed relative to the valve needle in such a way that it is not actuated by the valve needle until after the valve needle has already executed part of its opening stroke motion.

The fundamental concept of the invention accordingly is a two-stage opening of the valve needle of the metering valve by means of a coupling body of great mass, which the valve needle upon opening strikes after a slight stroke, after which it continues its opening motion jointly with the coupling body. The valve needle is braked by its impact with the coupling body. The valve needle remains in the region of the seat throttling for a relatively long period, and the time available for metering a small quantity accordingly increases markedly, compared to the length of time that the valve needle is unbraked. The influence of the speed of motion of the valve needle on the preinjection quantity decreases, and markedly more-precise metering of the preinjection quantity is made possible.

Any sacrifices in performance in metering large injection quantities can be kept slight, since only the opening behavior of the valve needle has to be influenced by the coupling body. Because of the greater mass inertia of the coupling body, it is easy to disconnect the valve needle from the coupling body upon closure of the valve needle, thus enabling the valve needle to execute a very fast closing motion.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
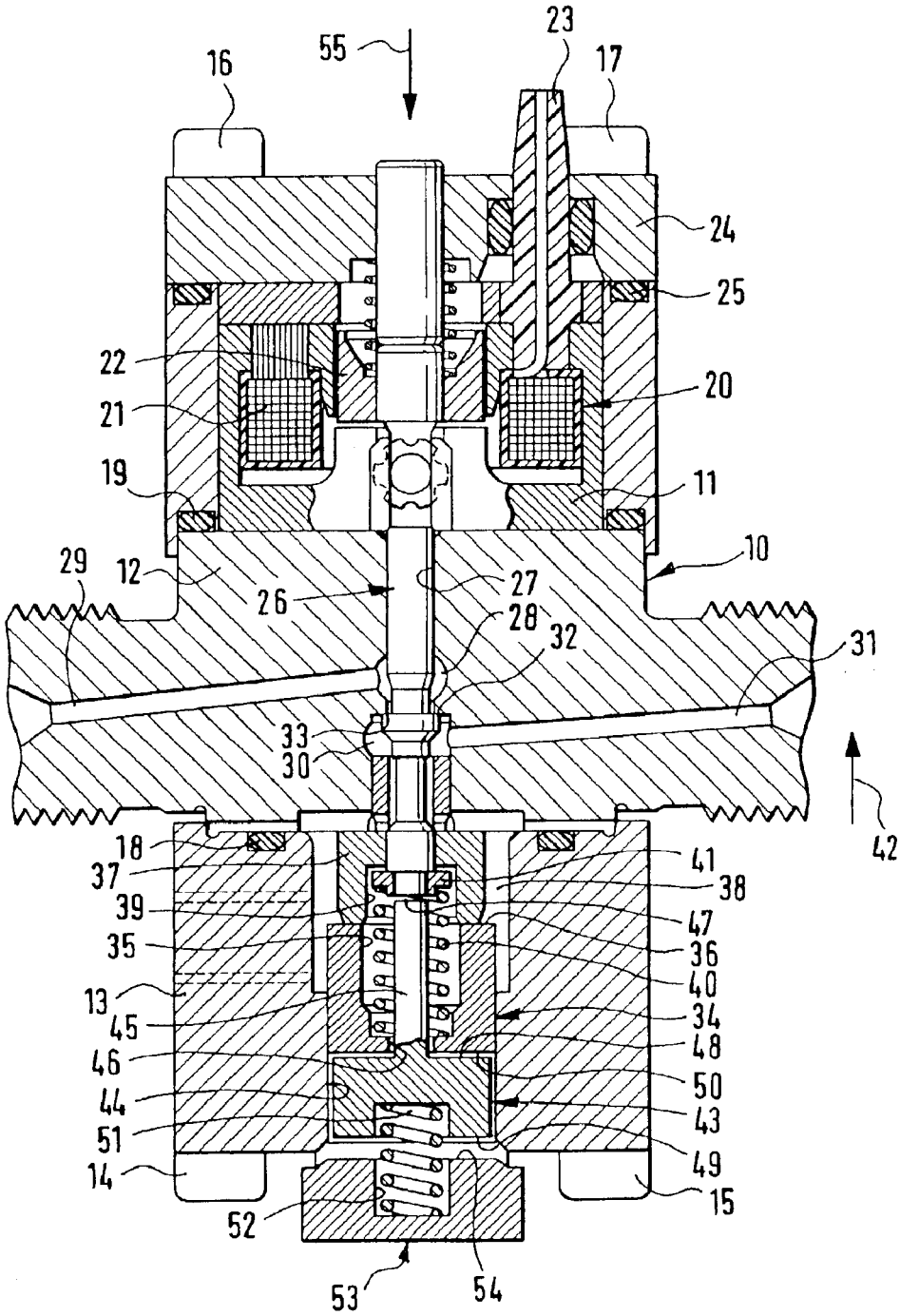
FIG. 1 shows one embodiment of a direct controlled so-called 3/2-way valve.

In FIG. 1, reference numeral 10 generally designates a valve body, which comprises three parts 11, 12 and 13 connected axially in line with one another. The valve body parts 11, 12 and 13 are joined to one another by screw bolts 14, 15 and 16, 17 and are sealed off from one another by O-ring seals 18, 19.

An electromagnet 20 with a coil winding 21, a magnet armature 22, and a current lead 23 is received in the upper valve body part 11. The current lead 23 for the electromagnet 20 is contained in a closure part 24, which is secured to the upper valve body part 11 by means of the screw bolts 16, 17, and is sealed off from it by an O-ring 25.

A valve needle, identified overall by reference numeral 26, is guided axially movably in a bore 27, serving as a valve needle guide, in the middle valve body part 12.

A conduit 29 in the middle valve body part 12, discharging into a first pressure chamber 28 annularly surrounding the valve needle 26, serves to provide high-pressure supply to the 3/2-way valve, from a so-called common rail (not shown). A similarly annularly embodied second pressure chamber 30 is located below the first pressure chamber 28, and from it, a conduit 31 leading to the injection nozzle (not shown) begins. The valve needle 26 has a sealing face or edge at 32, which cooperates with a valve seat 33 embodied above the second pressure chamber 30.

A cup-shaped insert 34, which has a recess 35, is screwed—from the direction of the back—into the lower valve body part 13. The upper end face 36 of the cup-shaped insert 34 comes to rest on a stepped guide bush 37, which is disposed—above the cup-shaped insert 34—partly in a recess 38 in the lower valve body part 13 and partly—below the pressure chamber 30—in the guide bore 27. The guide bush 37 has a recess 39, which in a certain sense forms the upper continuation of the recess 35 of the cup-shaped insert 34. The two recesses 35, 39 serve to receive a valve compression spring 40, which is braced on one end (at the bottom) on the bottom of the recess 35 in the cup-shaped insert 34 and on the other (at the top) via a disk 41 on the valve needle 26, urging it with force in the direction of the arrow 42. Thus by means of the valve compression spring 40 (when the electromagnet 20 is without current), the valve needle 26 is held in the closing position visible in FIG. 1.

A special feature is that below the cup-shaped insert 34, a coupling body 43 is disposed axially displaceably in a bore 44 in the lower valve body part 13. The coupling body 43 has a peg part 45, which is coaxial with the valve needle 26 and which penetrates the cup-shaped insert 34 in a bore 46 and protrudes at the top into the recesses 35, 39; the peg part is concentrically surrounded by the valve compression spring 40. The peg part 45 ends just below the valve needle 26 (which is in its closing position), in such a way that between the lower end of the valve needle and the upper end of the peg part 45, a gap 47 is formed. The essential aspect of the coupling body 43 is considered to be that it has a substantially greater mass than the valve needle 26. The coupling body 43 has an upper—flat-faced—stroke stop 48 and a lower—also flat-faced—stroke stop 49. The upper stroke stop 48 of the coupling body 43 cooperates with an upper counterpart stop 50, which is formed by the lower end face of the cup-shaped insert 34. By means of a compression spring 51, the upper stroke stop 48 of the coupling body 43 and the counterpart stop 50 are kept in contact—in the closing position of the valve needle 26. The compression spring 51 is received in a recess 52 of a retaining part 53 disposed below and connected to the valve body part 13. The retaining part 53, on its top side 54, forms a lower counterpart stop for the lower stroke stop 49 of the coupling body 43.

The 3/2-way valve shown in FIG. 1 and described above functions as follows.

In the currentless state of the electromagnet 20, the valve needle 26 is pressed by the valve compression spring 40 into the valve seat 33 and closes it. If current is then supplied to the electromagnet 20, the magnetic force of it acts on the valve needle 26 and accelerates in the opening direction 55. The valve opens, and fuel is pumped. After a short travel, that is, after bridging of the gap 47, which is smaller than the stroke that the valve needle 26 executes during a typical preinjection, the valve needle 26 strikes the coupling body 43. Because of the mass inertia of the coupling body 43, the valve needle 26 is braked. Since the magnet force continues to be applied, the coupling body 43 and the valve needle 26 are moved jointly onward in the valve opening direction 55. Depending on the duration of triggering of the electromagnet 20, the valve needle 26 together with the coupling body 43 reaches the lower counterpart stop 54 (where the coupling body 43 comes to rest with its lower stroke stop 49), or begins its closing motion again even before reaching stop 49 (in the direction of the arrow 42).

In this closing motion, the coupling body 43, because of its greater mass inertia in comparison to the valve needle 26, separates from the valve needle 26 and is moved by the compression spring 51—comparatively slowly—into its outset position visible in FIG. 1, in which the upper stroke stop 48 of the coupling body 43 comes into contact with the (upper) counterpart stop 50. The valve needle 26 thus closes much more quickly than the coupling body 43 reaches its (upper) outset position.

Figure 2:
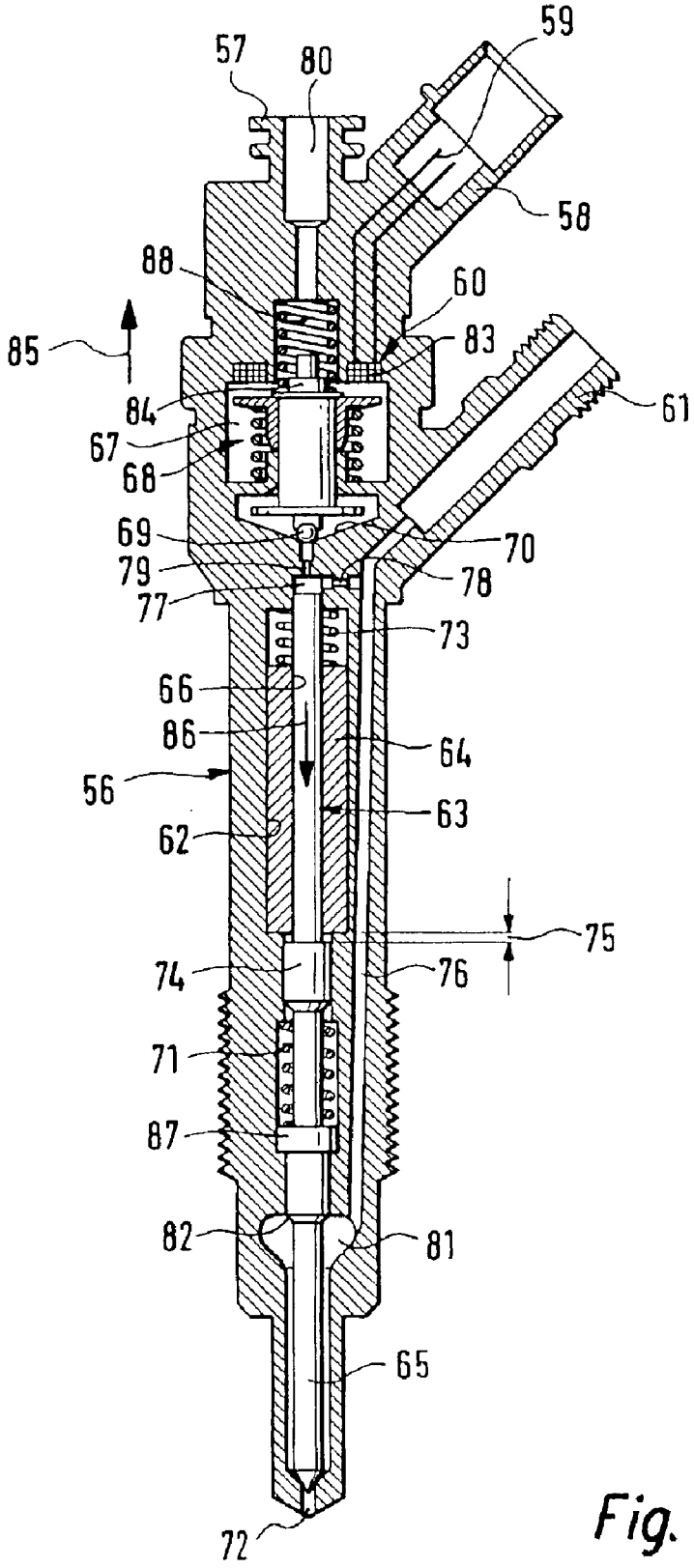
FIG. 2 shows one embodiment of a common rail injector.

FIG. 2 shows a comparable function of the graduated valve opening by means of a coupling mass, using a common rail injector as an example, which is a servo-hydraulically actuated fuel injection valve.

Reference numeral 56 indicates a housing body, with a formed-on outlet stub 57 and a plug housing 58 with a current connection 59 for an electromagnet—identified overall by reference numeral 60. A high-pressure connection—also communicating with the housing body 56 of the common rail injector—is identified by reference numeral 61. It is connected to a high-pressure fuel reservoir (or so-called common rail, not shown). A multiply graduated axial recess 62 is machined into the inside of the housing body 56, and a valve control piston 63, coupling body 64 and valve needle 65 are disposed axially movably in it. The coupling body 64 has an axial bore 66, which is penetrated by the valve control piston 63. The coupling body 64 is accordingly embodied in a certain sense as a hollow body or annular body.

Reference numeral 67 designates a valve control chamber, in which a magnet control valve 68 with a valve ball 69 is disposed. The valve ball 69 cooperates with a conical valve seat 70 of the magnet control valve 68. A restoring compression spring 71 keeps the valve needle 65 in its position shown in FIG. 2, in which the valve needle 65 closes an injection nozzle 72 located on the lower end of the housing body 56. The coupling body 64 is kept in its (lower) outset position, shown in FIG. 2, by a further restoring compression spring 73, and in this position, a narrow gap 75 is embodied between the coupling body 64 on the one hand and a thickened portion 74 of the valve control piston 63 on the other.

A pressure conduit 76 also extends inside the housing body 56; it communicates hydraulically with the high-pressure connection 61 and serves to supply fuel to the injection nozzle 72. Embodied above the valve control piston 63 is a control chamber 77, which communicates hydraulically with the pressure conduit 76 via an inlet throttle 78 and with the valve control chamber 67 and a fuel return 80 via an outlet throttle 79. Thus from the high-pressure connection 61, the fuel is carried via the pressure conduit 76 to the injection nozzle 72 and via the inlet throttle 78 into the control chamber 77. The hydraulic communication of the control chamber 77 with the fuel return 80 can be established—via the outlet throttle 79—by opening the magnet control valve 68.

In the closed state of the outlet throttle 79, the hydraulic force acting on the valve control piston 63 from the control chamber 77 predominates over the hydraulic force that is exerted on a pressure step 82 of the valve needle 65 by the fuel located in the high-pressure conduit 76, via a pressure chamber 81. As a consequence, the valve needle 65 is pressed with its sealing face into its seat at 72 and closes the high-pressure conduit 76 tightly off from the combustion chamber (not shown) of the engine. Thus no fuel can reach the combustion chamber.

If the coil marked 83 of the electromagnet 60 is now supplied with current, then a force in the direction of the arrow 85 is exerted on the magnet armature 84 that actuates the magnet control valve 68, and by this force, the magnet control valve 68 and thus also the outlet throttle 79 are opened. As a result, the pressure in the control chamber 77 drops, and the hydraulic force on the valve piston 63 decreases accordingly. As soon as the hydraulic force acting on the valve control piston 63 in the direction of the arrow 86 from the control chamber 77 becomes less than the force exerted on the valve needle 65 from the pressure chamber 81 via the pressure step 82, the valve needle 65 moves in the direction of the arrow 85 and uncovers the injection nozzle 72. Fuel from the high-pressure conduit 76 can now flow through the injection nozzle 72 to reach the combustion chamber of the engine.

The operation described above involves an indirect triggering of the valve needle 65 via a hydraulic force booster system. This system is used because the forces required for comparatively fast opening of the valve needle 65 cannot be generated by the magnet valve 68 directly. The so-called control quantity required in addition to the injected fuel quantity reaches the fuel return 80 via the throttles 78, 79 of the control chamber 77.

The special feature now is that the valve control piston 63, in the above-described opening motion, in which it is actuated by the valve needle 65, moving in the direction of the arrow 85, via a pressure piece 87, strikes the coupling body 64 after only a short travel distance, namely after overcoming the width of the gap 75. Because of its comparatively great mass and the resultant mass inertia force (which acts in the direction of the arrow 86), the valve control piston 63 and thus also the valve needle 65 are braked in their opening direction (direction of the arrow 85).

The closing motion of the valve needle 65 (in the direction of the arrow 86) is initiated by switching off the current to the electromagnet 60. A compression spring 88, acting on the magnet armature 84 in the direction of the arrow 86, can now actuate the magnet control valve 68 accordingly, until the valve ball 69 closes the valve seat 70 and thus the outlet throttle 79. The high pressure prevailing in the high-pressure conduit 76 now builds up—via the inlet throttle 88—in the valve control chamber 77. The same pressure also prevails in the chamber volume (pressure chamber 81) of the valve needle 65. The forces exerted by the high rail pressure on the end faces of the valve control piston 63 and the restoring compression spring 71—acting in the direction of the arrow 86—keep the valve needle 65 closed, counter to the opening force which engages the pressure step 82 of the valve needle 65.

Because of the lesser mass of the system comprising the valve control piston 63 and valve needle 65, compared to the mass of the coupling body 64, in the closing motion as described above a decoupling of the system 63/65 from the coupling body 64 takes place, so that the closing motion of the valve needle 65 can ensue quickly, and without being braked by the mass inertia forces of the coupling body 64. The coupling body is acted upon by force in the direction of the arrow 86 by the restoring compression spring 73 and moved into its outset position—visible in FIG. 2.

The foregoing relates to preferred exemplary embodiments of the invention, it being understood that other variants and embodiments thereof are possible within the spirit and scope of the invention, the latter being defined by the appended claims.

We claim:

1. A stroke-controlled valve as a fuel metering device of an injection system for internal combustion engines, comprising a valve body (10, 56) with a valve seat (33, 72)

a valve needle (26, 65), actuatable in the valve body (10, 56) counter to the resistance of a valve needle restoring spring (40, 71), the valve needle having a sealing face cooperating with the valve seat, a coupling body (43, 64) with a greater mass than the valve needle (26, 65) disposed in the valve body (10, 56), in the axial extension of the valve needle (26, 65) and movable coaxially to the valve needle, the coupling body being actuatable by the valve needle during the opening stroke of the valve needle (26, 65), wherein the coupling body (43, 64) is disposed relative to the valve needle (26, 65) such that it is not actuated by the valve needle (26, 65) until after the valve needle has already executed a portion of its opening stroke motion.

2. The stroke-controlled valve of claim 1, wherein the valve needle (26), on one end, is actuatable by an electromagnet (20) in the opening direction (55) and on its other (free end) is actuatable by the valve restoring spring (40) in the closing direction (42), and wherein the valve needle (26), on its end face toward the restoring spring, cooperates with the coupling body (43).

3. The stroke-controlled valve of claim 2, further comprising an axial gap (47, 75) in the closing position of the valve needle (26, 65), between the end face of the valve needle oriented toward and actuating the coupling body (43, 64) and an end face of the coupling body (43, 64) cooperating with the valve needle (26, 65), the gap being embodied such that the valve needle (26, 65) does not come into contact with the coupling body (43, 64) until after a portion of its opening stroke motion.

4. The stroke-controlled valve of claim 3, further comprising a multi-part valve body (10) including a first valve body part (11) containing the electromagnet (20) used to actuate the valve needle (26), a second valve body part (12) including a guide for the valve needle (26), valve seat (33), the pressure chambers (28, 30) and pressure conduits (29, 31) and a third valve body part (13) adjoining the middle valve body part (12) in the valve needle opening direction (55), the third valve body part (13) receiving the coupling body (43).

5. The stroke-controlled valve of claim 1, further comprising an axial gap (47, 75) in the closing position of the valve needle (26, 65), between the end face of the valve needle oriented toward and actuating the coupling body (43, 64) and an end face of the coupling body (43, 64) cooperating with the valve needle (26, 65), the gap being embodied such that the valve needle (26, 65) does not come into contact with the coupling body (43, 64) until after a portion of its opening stroke motion.

6. The stroke-controlled valve of claim 5, wherein a first opening stroke of the valve needle (26, 65) is used for a preinjection and a second opening stroke is used for an (ensuing) main injection, and wherein the axial gap (47, 75), embodied between the two cooperating end faces of the valve needle (26, 65) on the one hand and the coupling body (43, 64) on the other, is smaller than the opening stroke, used for the preinjection, of the valve needle (26, 65).

7. The stroke-controlled valve of claim 6, wherein the coupling body (43) is acted upon on its back side (49), remote from the valve needle (26), by a compression spring (51), such that in the closing position of the valve needle (26), it is kept in contact with a first (upper) stroke stop (48)—on the side toward the valve needle—with the associated counterpart stop (50) in the valve body (10, 13).

8. A The stroke-controlled valve of claim 5, wherein the coupling body (43) comprises two stops (48, 49), which limit its axial mobility in the valve body (10), each of which stops cooperate with a respective counterpart stop (50 and 54, respectively) on the valve body (10, 13), or a part (53) connected to it.

9. The stroke-controlled valve of claim 5, wherein the coupling body (43) is acted upon on its back side (49), remote from the valve needle (26), by a compression spring (51), such that in the closing position of the valve needle (26), it is kept in contact with a first (upper) stroke stop (48)—on the side toward the valve needle—with the associated counterpart stop (50) in the valve body (10, 13).

10. The stroke-controlled valve of claim 9, wherein the counterpart stop (50) for the first (upper) stop (48) of the coupling body (43) is formed by the end face on the back side of a cup-shaped insert (34), and wherein toward the valve needle the coupling body (43) has a peg part (45), which is coaxial with the valve needle (26) and which penetrates the bottom of the valve body insert (34) in a bore (46) and serves in cooperation with the valve needle (26) to actuate the coupling body (43).

11. The stroke-controlled valve of claim 1, wherein the coupling body (43) comprises two stops (48, 49), which limit its axial mobility in the valve body (10), each of which stops cooperate with a respective counterpart stop (50 and 54, respectively) on the valve body (10, 13), or a part (53) connected to it.

12. The stroke-controlled valve of claim 9, wherein the coupling body (43) is acted upon on its back side (49), remote from the valve needle (26), by a compression spring (51), such that in the closing position of the valve needle (26), it is kept in contact with a first (upper) stroke stop (48)—on the side toward the valve needle—with the associated counterpart stop (50) in the valve body (10, 13).

13. The stroke-controlled valve of claim 11, wherein the counterpart stop (50) for the first (upper) stop (48) of the coupling body (43) is formed by the end face on the back side of a cup-shaped insert (34), and wherein toward the valve needle the coupling body (43) has a peg part (45), which is coaxial with the valve needle (26) and which penetrates the bottom of the valve body insert (34) in a bore (46) and serves in cooperation with the valve needle (26) to actuate the coupling body (43).

14. The stroke-controlled valve of claim 13, wherein the valve needle restoring spring (40) is received by the cup-shaped valve body insert (34) and thereby concentrically surrounds the peg part (45) of the coupling body (43).

15. The stroke-controlled valve of claim 1, wherein the coupling body (43, 64) is actuatable by the valve needle (26, 65) only in the opening direction (55, 85) thereof, but not also in the closing direction (42, 86).

16. The stroke-controlled valve of claim 15, wherein the counterpart stop (50) for the first (upper) stop (48) of the coupling body (43) is formed by the end face on the back side of a cup-shaped insert (34), and wherein toward the valve needle the coupling body (43) has a peg part (45), which is coaxial with the valve needle (26) and which penetrates the bottom of the valve body insert (34) in a bore (46) and serves in cooperation with the valve needle (26) to actuate the coupling body (43).

17. The stroke-controlled valve of claim 1, in particular a common rail injector, further comprising a valve control piston (63) operable to actuate the valve needle (65) in both the closing direction (86) and the opening direction (85) by the fuel arriving from a high-pressure reservoir and delivered to a high-pressure connection (61) and an adjoining high-pressure conduit (76), and a magnet control valve (68) triggered by an electromagnet (60) controls the high-pressure actuation of the valve control piston (63) and thus of the valve needle (65) via two throttles (78, 79) hydraulically communicating with the high-pressure connection (61) and the high-pressure conduit (76), respectively, the coupling body (64) being embodied as a hollow body or annular body and having a through bore (66), which is coaxial with the valve needle (65) and which is penetrated by the valve control piston (63).

18. The stroke-controlled valve of claim 17, wherein the valve control piston (63), on the side thereof toward the valve needle outside the coupling body (64), comprises a graduated thickened portion (74) whose diameter exceeds the inside diameter of the through bore (66) of the coupling body (64), the thickened portion (74) serving to actuate the coupling body (64) in the valve opening direction (85); and an axial gap (75) between the end toward the valve needle of the coupling body (64) and the thickened portion (74) of the valve control piston (63) in the closing position of the valve needle (65).

* * * * *